US009472132B2

(12) United States Patent
Kaplan et al.

(10) Patent No.: US 9,472,132 B2
(45) Date of Patent: Oct. 18, 2016

(54) DISPLAY DEVICE AND DRIVING METHOD THEREOF

(71) Applicant: SAMSUNG DISPLAY CO., LTD., Yongin, Gyeonggi-Do (KR)

(72) Inventors: Leonid Kaplan, Yongin (KR); Heung-Yeol Na, Yongin (KR); Baek-Woon Lee, Yongin (KR); Won-Sik Hyun, Yongin (KR); Jae-Hoon Lee, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 97 days.

(21) Appl. No.: 14/328,168

(22) Filed: Jul. 10, 2014

(65) Prior Publication Data

US 2015/0054862 A1 Feb. 26, 2015

(30) Foreign Application Priority Data

Aug. 22, 2013 (KR) ..... 10-2013-0099936

(51) Int. Cl.
*G09G 3/20* (2006.01)
*G09G 3/32* (2016.01)

(52) U.S. Cl.
CPC ..... *G09G 3/2022* (2013.01); *G09G 3/204* (2013.01); *G09G 3/3225* (2013.01); *G09G 2320/0233* (2013.01); *G09G 2320/045* (2013.01); *G09G 2360/16* (2013.01); *G09G 2360/18* (2013.01)

(58) Field of Classification Search
None
See application file for complete search history.

(56) References Cited

U.S. PATENT DOCUMENTS

| | | | | |
|---|---|---|---|---|
| 6,014,258 | A | 1/2000 | Naka et al. | |
| 2013/0147857 | A1* | 6/2013 | Kurikko | G09G 3/20 345/690 |

FOREIGN PATENT DOCUMENTS

| | | |
|---|---|---|
| KR | 10-0731028 | 6/2007 |
| KR | 10-2008-0096379 A | 10/2008 |
| KR | 10-2012-0028004 A | 3/2012 |

* cited by examiner

*Primary Examiner* — Kenneth B Lee, Jr.
(74) *Attorney, Agent, or Firm* — Lee & Morse, P.C.

(57) ABSTRACT

A display device includes a timing controller for controlling the display of an image. The timing controller forms a frame for an image signal based on a main frame, a compensation frame, and at least one blank frame. The timing controller also determines a driving method for the display pixels to generate output image data. The main frame serves to display the image signal. The compensation frame serves to compensate luminance of the main frame. The blank frame serves to express a black gray scale value.

25 Claims, 21 Drawing Sheets

FIG. 3

| SF | SF1 | SF2 | SF3 | SF4 | SF5 | SF6 | SF7-1 | SF7-2 | SF8-1 | SF8-2 | SF8-3 | SF8-4 |
|---|---|---|---|---|---|---|---|---|---|---|---|---|
| TIME | 1 | 2 | 4 | 8 | 16 | 32 | 32 | 32 | 32 | 32 | 32 | 32 |

DISPLAY DEVICE AND DRIVING METHOD THEREOF

CROSS-REFERENCE TO RELATED APPLICATION

Korean Patent Application No. 10-2013-0099936, filed on Aug. 22, 2013, and entitled, "Display Device and Driving Method Thereof," is incorporated by reference herein in its entirety.

BACKGROUND

1. Field

One or more embodiments described herein relate to a display device.

2. Description of the Related Art

Various types of flat display devices have been developed. One type, known as an organic light emitting diode display, displays images using an organic light emitting diode (OLED). This diode generates light based on the recombination of electrons and holes in a active layer. OLED displays have fast response speeds, are driven with low power consumption, and have excellent emission efficiency, luminance, and viewing angle. In operation, each OLED emits light of a predetermined luminance corresponding to a data current supplied from a pixel circuit.

An OLED display may be driven using various methods. One method is a digital driving method which controls an on-time of a pixel based on a frame. The frame is divided into a plurality of sub-frames, and a light emitting period of each sub-frame is appropriately set in order to display light of a specific gray scale value. OLED displays have drawbacks, one of which includes luminance non-uniformity generated by voltage drops in a power source voltage. The voltage drops may be caused by various factors including but not limited to an increase in display size and different threshold voltages of each OLED element.

SUMMARY

In accordance with one embodiment, a display device includes a display configured to include a plurality of pixels; and a timing controller configured to form a frame of an image signal by using a main frame, a compensation frame, and at least one blank frame and determine a driving method of each of the pixels to generate output image data. The main frame serves to display the image signal, the compensation frame serves to compensate a luminance of the main frame, and the blank frame serves to express a black grayscale.

The timing controller may include a sub-frame controller, and the sub-frame controller may include: a luminance measurer configured to measure a luminance value of at least one area of the display; a sub-frame generator configured to convert the image signal into a main image data signal; and a luminance compensator configured to generate a compensation image data signal for compensating a luminance according to the image signal by using the measured luminance value.

The timing controller may further include a sub-frame arranging unit, the sub-frame arranging unit may form a frame of the image signal with the main frame, the compensation frame, and the blank frame, and the sub-frame arranging unit may generate an output image data signal by arranging the main image data signal corresponding to a period of the main frame, the compensation image data signal corresponding to a period of the compensation frame, and an image data signal corresponding to a period of the blank frame.

The frame of the image signal may include a main frame, a compensation frame, and a blank frame arranged in that order, each of the main frame and the compensation frame may include a plurality of sub-frames, the main frame may include sub-frames having weight values of grayscale 1, grayscale 4, grayscale 16, grayscale 64, grayscale 128, grayscale 32, grayscale 8, and grayscale 2 which are successively arranged, and the compensation frame may include sub-frames having weight values of grayscale 1, grayscale 4, grayscale 16, grayscale 64, grayscale 128, grayscale 32, grayscale 8, and grayscale 2 which are successively arranged.

The frame of the image signal may include a main frame, a compensation frame, and a blank frame arranged in that order, each of the main frame and the compensation frame may include a plurality of sub-frames, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame may include sub-frames having weight values of grayscale 1, grayscale 2, grayscale 4, grayscale 8, grayscale 16, grayscale 32, and grayscale 64 which are successively arranged.

The frame of the image signal may include a main frame, a first blank frame, a compensation frame, and a second blank frame arranged in that order, each of the main frame and the compensation frame may include a plurality of sub-frames, the main frame may include sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame may include sub-frames having weight values of grayscale 1, grayscale 2, grayscale 4, grayscale 8, grayscale 16, grayscale 32, and grayscale 64 which are successively arranged.

The frame of the image frame may include a main frame, a compensation frame, and a blank frame arranged in that order, each of the main frame and the compensation frame may include a plurality of sub-frames, the main frame may include sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame may include sub-frames having weight values of grayscale 1, grayscale 2, grayscale 4, grayscale 8, grayscale 16, grayscale 32, and grayscale 64 which are successively arranged.

The frame of the image signal may include a main frame having a first blank frame, a compensation frame, and a second blank frame arranged in that order, each of the main frame and the compensation frame may include a plurality of sub-frames, the main frame may include sub-frames having weight values of grayscale 1, grayscale 2, grayscale 4, grayscale 8, grayscale 16, grayscale 32, grayscale 64, grayscale 0, grayscale 1, grayscale 2, grayscale 4, grayscale 8, grayscale 16, grayscale 32, and grayscale 64 which are successively arranged, and the compensation frame may include sub-frames having weight values of grayscale 1, grayscale 2, grayscale 4, grayscale 8, grayscale 16, grayscale 32, and grayscale 64 which are successively arranged.

The frame of the image signal may include a first main frame, a compensation frame, a second main frame, and a blank frame arranged in that order, each of the first main frame, the compensation frame, and the second main frame may include a plurality of sub-frames, the first main frame includes sub-frames having weight values of grayscale 1, grayscale 2, grayscale 4, grayscale 8, grayscale 16, grayscale 32, and grayscale 64 which are successively arranged, the compensation frame may include sub-frames having weight values of grayscale 1, grayscale 2, grayscale 4, grayscale 8, grayscale 16, grayscale 32, and grayscale 64 which are successively arranged, and the second main frame may include sub-frames having weight values of grayscale 1, grayscale 2, grayscale 4, grayscale 8, grayscale 16, grayscale 32, and grayscale 64 which are successively arranged.

The frame of the image signal may include a first main frame, a first blank frame, a compensation frame, a second blank frame, a second main frame, and a third blank frame arranged in that order, each of the first main frame, the compensation frame, and the second main frame may include a plurality of sub-frames, the first main frame may include sub-frames having weight values of grayscale 1, grayscale 2, grayscale 4, grayscale 8, grayscale 16, grayscale 32, and grayscale 64 which are successively arranged, the compensation frame may include sub-frames having weight values of grayscale 1, grayscale 2, grayscale 4, grayscale 8, grayscale 16, grayscale 32, and grayscale 64 which are successively arranged, and the second main frame may include sub-frames having weight values of grayscale 1, grayscale 2, grayscale 4, grayscale 8, grayscale 16, grayscale 32, and grayscale 64 which are successively arranged.

The frame of the image signal may include a first compensation frame, a main frame, a second compensation frame, and a blank frame arranged in that order, each of the first main frame, the compensation frame, and the second main frame may include a plurality of sub-frames, the first compensation frame may include sub-frames having weight values of grayscale 1, grayscale 2, grayscale 4, grayscale 8, grayscale 16, and grayscale 32 which are successively arranged, the main frame may include sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the second compensation frame may include sub-frames having weight values of grayscale 1, grayscale 2, grayscale 4, grayscale 8, grayscale 16, and grayscale 32 which are successively arranged.

The frame of the image signal may include a first compensation frame, a first blank frame, a main frame, a second blank frame, a second compensation frame, and a third blank frame arranged in that order, each of the first compensation frame, the main frame, and the second compensation frame may include a plurality of sub-frames, the first compensation frame may include sub-frames having weight values of grayscale 1, grayscale 2, grayscale 4, grayscale 8, grayscale 16, and grayscale 32 which are successively arranged, the main frame may include sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the second compensation frame may include sub-frames having weight values of grayscale 1, grayscale 2, grayscale 4, grayscale 8, grayscale 16, and grayscale 32 which are successively arranged.

Each of the main frame and the compensation frame may include a plurality of sub-frames, and the frame of the image signal may include a first main frame of grayscale 1, a first compensation frame of grayscale 2, a second main frame of grayscale 4, a second compensation frame of grayscale 8, a third main frame of grayscale 16, a third compensation frame of grayscale 32, a fourth main frame of grayscale 64, a fifth main frame of grayscale 128, a fourth compensation frame of grayscale 64, a sixth main frame of grayscale 32, a fifth compensation frame of grayscale 16, a seventh main frame of grayscale 8, a sixth compensation frame of grayscale 4, an eighth main frame of grayscale 2, a seventh compensation frame of grayscale 1, and a blank frame arranged in that order.

In accordance with another embodiment, a method of driving a display device by dividing a frame of an image signal into a main frame for displaying the image signal, a compensation frame for compensating luminance of the main frame, and a blank frame for expressing a black grayscale, including: measuring a luminance value of at least one area of a display; converting the image signal into a main image data signal; generating a compensation image data signal for compensating luminance according to the image signal by using the measured luminance value; and forming a frame of the image signal by using the main frame, the compensation frame, and a blank frame.

The forming a frame of the image signal by using the main frame, the compensation frame, and a blank frame may include generating an output image data signal by arranging the main image data signal corresponding to a period of the main frame, the compensation image data signal corresponding to a period of the compensation frame, and an image data signal corresponding to a period of the blank frame.

The frame of the image signal may include a main frame, a compensation frame, and a blank frame arranged in that order, each of the main frame and the compensation frame may include a plurality of sub-frames, the main frame may include sub-frames having weight values of grayscale 1, grayscale 4, grayscale 16, grayscale 64, grayscale 128, grayscale 32, grayscale 8, and grayscale 2 which are successively arranged, and the compensation frame may include sub-frames having weight values of grayscale 1, grayscale 4, grayscale 16, grayscale 64, grayscale 128, grayscale 32, grayscale 8, and grayscale 2 which are successively arranged.

The frame of the image signal may include a main frame, a compensation frame, and a blank frame arranged in that order, each of the main frame and the compensation frame may include a plurality of sub-frames, the main frame may include sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame may include sub-frames having weight values of grayscale 1, grayscale 2, grayscale 4, grayscale 8, grayscale 16, grayscale 32, and grayscale 64 which are successively arranged.

The frame of the image signal may include a main frame, a first blank frame, a compensation frame, and a second blank frame arranged in that order, each of the main frame and the compensation frame may include a plurality of sub-frames, the main frame may include sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame may include sub-frames having weight values of grayscale 1, grayscale 2, grayscale 4, grayscale 8, grayscale 16, grayscale 32, and grayscale 64 which are successively arranged.

The frame of the image signal may include a main frame, a compensation frame, and a blank frame arranged in that order, each of the main frame and the compensation frame may include a plurality of sub-frames, the main frame may include sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame may include sub-frames having weight values of grayscale 1, grayscale 2, grayscale 4, grayscale 8, grayscale 16, grayscale 32, and grayscale 64 which are successively arranged.

The frame of the image signal may include a main frame having a first blank frame, a compensation frame, and a second blank frame arranged in that order, each of the main frame and the compensation frame may include a plurality of sub-frames, the main frame may include sub-frames having weight values of grayscale 1, grayscale 2, grayscale 4, grayscale 8, grayscale 16, grayscale 32, grayscale 64, grayscale 0, grayscale 1, grayscale 2, grayscale 4, grayscale 8, grayscale 16, grayscale 32, and grayscale 64 which are successively arranged, and the compensation frame may include sub-frames having weight values of grayscale 1, grayscale 2, grayscale 4, grayscale 8, grayscale 16, grayscale 32, and grayscale 64 which are successively arranged.

The frame of the image signal may include a first main frame, a compensation frame, a second main frame, and a blank frame arranged in that order, each of the first main frame, the compensation frame, and the second main frame may include a plurality of sub-frames, the first main frame may include sub-frames having weight values of grayscale 1, grayscale 2, grayscale 4, grayscale 8, grayscale 16, grayscale 32, and grayscale 64 which are successively arranged, the compensation frame may include sub-frames having weight values of grayscale 1, grayscale 2, grayscale 4, grayscale 8, grayscale 16, grayscale 32, and grayscale 64 which are successively arranged, and the second main frame may include sub-frames having weight values of grayscale 1, grayscale 2, grayscale 4, grayscale 8, grayscale 16, grayscale 32, and grayscale 64 which are successively arranged.

The frame of the image signal may include a first main frame, a first blank frame, a compensation frame, a second blank frame, a second main frame, and a third blank frame arranged in that order, each of the first main frame, the compensation frame, and the second main frame may include a plurality of sub-frames, the first main frame may include sub-frames having weight values of grayscale 1, grayscale 2, grayscale 4, grayscale 8, grayscale 16, grayscale 32, and grayscale 64 which are successively arranged, the compensation frame may include sub-frames having weight values of grayscale 1, grayscale 2, grayscale 4, grayscale 8, grayscale 16, grayscale 32, and grayscale 64 which are successively arranged, and the second main frame may include sub-frames having weight values of grayscale 1, grayscale 2, grayscale 4, grayscale 8, grayscale 16, grayscale 32, and grayscale 64 which are successively arranged.

The frame of the image signal may include a first compensation frame, a main frame, a second compensation frame, and a blank frame arranged in that order, each of the first main frame, the compensation frame, and the second main frame may include a plurality of sub-frames, the first compensation frame may include sub-frames having weight values of grayscale 1, grayscale 2, grayscale 4, grayscale 8, grayscale 16, and grayscale 32 which are successively arranged, the main frame may include sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the second compensation frame may include sub-frames having weight values of grayscale 1, grayscale 2, grayscale 4, grayscale 8, grayscale 16, and grayscale 32 which are successively arranged.

The frame of the image signal may include a first compensation frame, a first blank frame, a main frame, a second blank frame, a second compensation frame, and a third blank frame arranged in that order, each of the first compensation frame, the main frame, and the second compensation frame may include a plurality of sub-frames, the first compensation frame may include sub-frames having weight values of grayscale 1, grayscale 2, grayscale 4, grayscale 8, grayscale 16, and grayscale 32 which are successively arranged, the main frame may include sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the second compensation frame may include sub-frames having weight values of grayscale 1, grayscale 2, grayscale 4, grayscale 8, grayscale 16, and grayscale 32 which are successively arranged.

Each of the main frame and the compensation frame may include a plurality of sub-frames, and the frame of the image signal may include a first main frame of grayscale 1, a first compensation frame of grayscale 2, a second main frame of grayscale 4, a second compensation frame of grayscale 8, a third main frame of grayscale 16, a third compensation frame of grayscale 32, a fourth main frame of grayscale 64, a fifth main frame of grayscale 128, a fourth compensation frame of grayscale 64, a sixth main frame of grayscale 32, a fifth compensation frame of grayscale 16, a seventh main frame of grayscale 8, a sixth compensation frame of grayscale 4, an eighth main frame of grayscale 2, a seventh compensation frame of grayscale 1, and a blank frame arranged in that order.

BRIEF DESCRIPTION OF THE DRAWINGS

Features will become apparent to those of skill in the art by describing in detail exemplary embodiments with reference to the attached drawings in which:

FIG. 3 illustrates sub-frames in one embodiment of a digitally driven frame;

DETAILED DESCRIPTION

Figure 1:
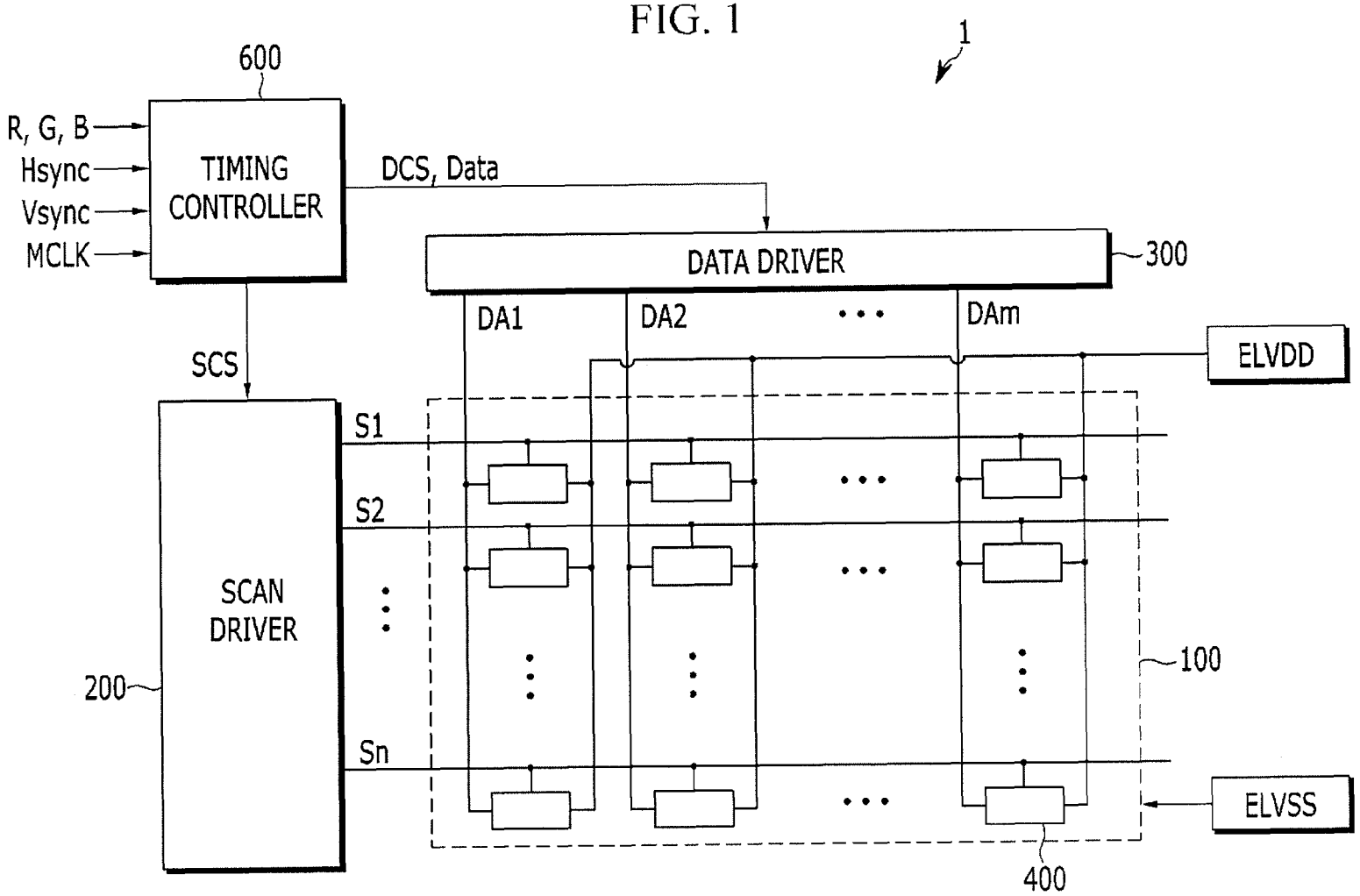
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display device 1 which includes a display 100 including a plurality of pixels 400, a scan driver 200, a data driver 300, and a timing controller 600. The pixels 400 are connected to a plurality of scan lines S1 to Sn and a plurality of data lines DA1 to DAm. The scan driver 200 applies scan signals to the pixels 400 through the scan lines S1 to Sn. The data driver 300 applies data signals to the pixels 400 through the data lines D1 to DAm. The timing controller 600 controls the scan driver 200 and the data driver 300.

The pixels 400 are powered by a first power source ELVDD and a second power source ELVSS, located outside the display device 1. The pixels 400 supply currents to an organic light emitting diodes (OLED) according to corresponding data signals, and the OLED emits light with predetermined luminance according to corresponding driving currents.

The timing controller 600 receives image signals R, G, and B from an external device and an input control signal for controlling displaying of the image signals. The image signals R, G, and B have luminance information of the pixels included in the respective pixels 400. The luminance information includes data for indicating a grayscale gradation value of a corresponding pixel among a predetermined number, for example, 1024 (210), 256 (28), or 64 (26) grayscale gradation values. The input control signals include a vertical synchronization signal Vsync, a horizontal synchronization signal Hsync, and a main clock signal MCLK.

The timing controller 600 uses the input control signals to process the image signals R, G, and B according to operational conditions of the display 10 and the data driver 300. The timing controller 600 generates a data control signal DCS and a scan control signal SCS. The data control signal DCS is supplied to the data driver 300, and the scan control signal SCS is supplied to the scan driver 200.

The timing controller 600 forms a frame of the image signals R, G, and B by using a main frame MF, a compensation frame CF, and at least one blank frame BF, and determines driving methods of the pixels 400.

The compensation frame CF may compensate luminance non-uniformity of the display device caused by voltage drops or different threshold voltages. In one embodiment, a compensation operation serves to compensate luminance non-uniformity of the display device caused by image signals R, G, and B and a voltage drop, or different threshold voltages the driving transistors of the OLED pixels by compensating a luminance difference of the image signals R, G, and B.

In one embodiment, the main frame MF serves to display the image signals R, G, and B. The compensation frame CF corresponds to the main frame MF and serves to compensate a luminance difference resulting from a luminance non-uniformity of the display device for image signals R, G, and B. The blank frame BF serves to express a black grayscale (grayscale 0).

The timing controller 50 converts the image signals R, G, and B into output image data signals (Data) per sub-frame and applies them to the data driver 300.

FIG. 3 illustrates an embodiment of sub-frames included in a digitally-driven frame. The sub-frames are arranged in order from a sub-frame 1 SF1 to a sub-frame 8-4 SF8-4. More specifically, the sub-frames are arranged in an ascending order of sub-frame SF1, sub-frame SF2, sub-frame SF3, sub-frame SF4, sub-frame SF5, sub-frame SF6, sub-frame SF7-1, sub-frame SF7-2, sub-frame SF8-1, sub-frame SF8-2, sub-frame SF8-3, and sub-frame F8-4. A light emitting period for expressing a grayscale value may be allocated to each sub-frame, and the numbers of light emitting periods corresponding to respective ones of the sub-frames are illustrative shown on the rows in the bottom of the table of FIG. 3.

In the aforementioned embodiment of the digital driving method, one frame is divided into a plurality of sub-frames. A sub-frame that is selected according to the image signal that is turned on for one frame period, to express a corresponding grayscale value. For example, sub-frame SF3 has four light emitting periods and sub-frame SF4 has eight light emitting periods. For example, when these periods are turned on once for one frame period, a grayscale value of 12 is expressed. When all of sub-frames SF1 to SF7-2 are turned on for one frame period, a grayscale value of 127 is expressed. When all of sub-frames SF8-1 to SF8-4 are turned on for one frame period, a grayscale value of 128 is expressed.

The data driver 30 applies a plurality of data signals to data lines DA1 to DAm for the sub-frames SF included in one frame according to the data control signal DCS. More specifically, the data driver 30 is synchronized with a point in time when a scan signal having a gate-on voltage corresponding to each of the sub-frames is applied to apply a plurality of data signals, for controlling whether or not the pixels 40 emit light through the data lines DA1 to DAm. The gate-on voltage signifies a voltage level for turning on a driving transistor TR for transmitting a current to the OLED.

The scan driver 200 is synchronized with a starting point of each sub-frame SF, to apply a scan signal having a gate-on voltage to a corresponding one of the scan lines S1 to Sn. Accordingly, the pixel(s) 400 connected to the scan lines to which the scan signal having a gate-on voltage (among the scan lines S1 to Sn) is/are applied is selected. The pixels 40 selected by the scan signal receive the data signal from the data lines DA1 to DAm according to the corresponding sub-frame. Herein, the corresponding sub-frame may signify a sub-frame that corresponds to the scan signal having a gate-on voltage.

The first power source ELVDD and second power source ELVSS respectively supply driving voltages for operation of pixels 400. The driving voltages include a high-level driving voltage supplied from the first power source ELVDD and a low-level driving voltage supplied from the second power source ELVSS.

Figure 2:
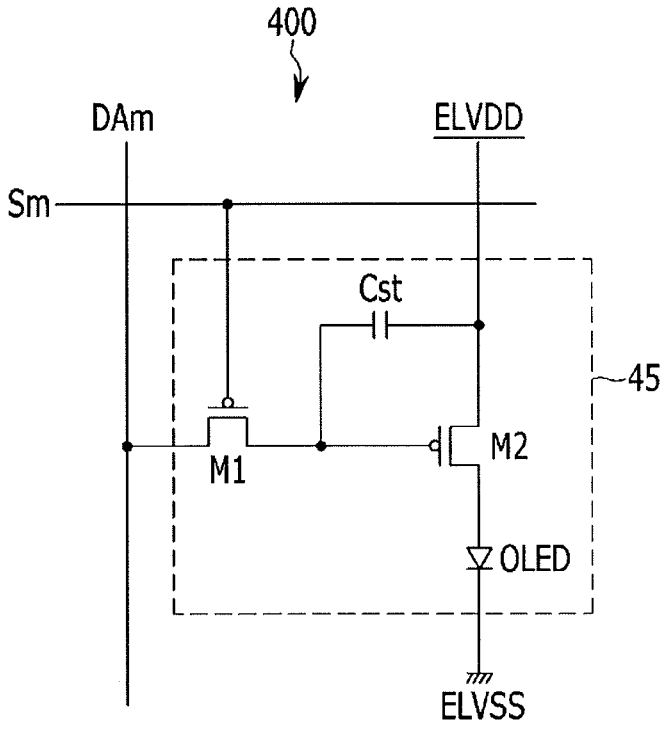
FIG. 2 illustrates an embodiment of a pixel circuit the display device.

FIG. 2 illustrates an embodiment of a pixel circuit 45 which includes a switching transistor M1, a driving transistor M2, a storage capacitor Cst, and an organic light emitting diode (OLED). The switching transistor M1 includes a gate electrode connected to a corresponding one of a plurality of scan lines, a source electrode connected to a corresponding one of a plurality of data lines, and a drain electrode connected to a contact point connected to one end of the storage capacitor and a gate electrode of the driving transistor M2.

The driving transistor M2 includes the gate electrode connected to the drain electrode of the switching transistor M1, a source electrode connected to a first power source ELVDD, and a drain electrode connected to an anode electrode of the OLED.

The storage capacitor has one terminal connected to a contact point connected to the drain electrode of the switching transistor M1 and the gate electrode of the driving transistor M2. The storage capacitor has another terminal connected to the source electrode of the driving transistor M2, to maintain a voltage difference between the gate electrode and the source electrode of the driving transistor M2 during a sub-frame.

The OLED has an anode electrode connected to the drain electrode of the driving transistor M2 and a cathode electrode connected to a second power source ELVSS.

When the switching transistor M1 is turned on according to a scan signal transferred through a corresponding scan line, a data signal transferred through the turned-on switching transistor M1 is transferred to the gate electrode of the driving transistor M2. Accordingly, a voltage difference between the gate electrode and the source electrode of the driving transistor M2 is the same as a difference between the data signal and a first driving voltage. A driving current flows in the driving transistor M2 according to the voltage difference. The driving current is transferred to the OLED, and the OLED emits light according to the transferred driving current.

When scan signals having gate-on voltage levels are applied to corresponding ones of the scan lines S1 to Sn, a plurality of switching transistors M1 connected to the corresponding scan lines are turned on. The data lines Da1 to Dam are synchronized with points of time when the scan signals having gate-on voltage levels are applied to receive data signals.

The data signals transferred to the data lines DA1 to DAm through the switching transistors M1 are transferred to the gate electrodes of driving transistors included in the respective pixels 400. Thus, light emission of the OLEDs in the respective pixels 400 is performed or is not performed according to the transferred data signals during corresponding sub-frames.

Figure 4:
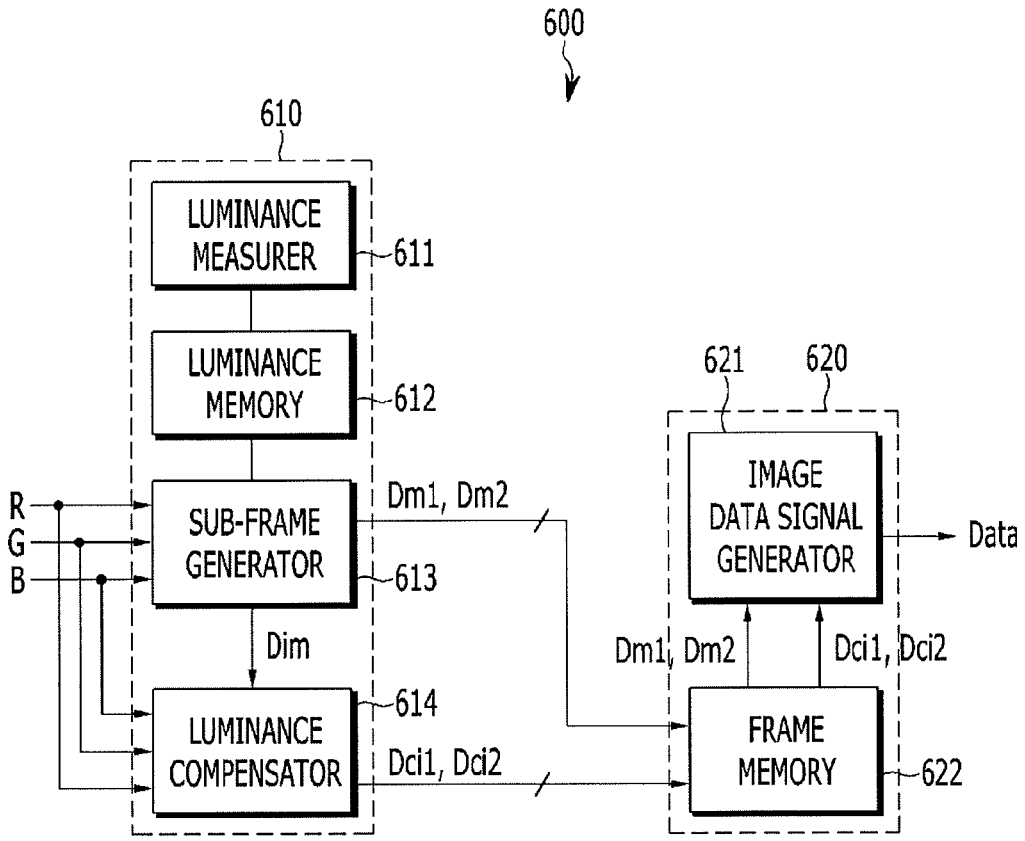
FIG. 4 illustrates an embodiment of a timing controller of the display device.

FIG. 4 illustrates an embodiment of a timing controller 600 for a display device. The timing controller may be used in any of the aforementioned embodiments of the display device or a different display device. As illustrated in FIG. 4, timing controller 600 includes a sub-frame controller 610 and a sub-frame arranging unit 620.

The sub-frame controller 610 includes a luminance measurer 611, a luminance memory 612, a sub-frame generator 613, and a luminance compensator 614. The luminance measurer 611 measures a luminance value of at least one area of the display and outputs the luminance value for storage in the luminance memory 612.

The sub-frame generator 613 converts the image signals R, G, and B into main image data signals Dm1 and outputs the main image data signals Dm1 to the sub-frame arranging unit 620. Further, the sub-frame generator 613 generates a measurement image data signal Dim based on the luminance value stored in the luminance memory 612. The sub-frame generator 613 may convert the image signals R, G, and B into main image data signals Dm2 based on Equation 1, in which v indicates a first measuring function.

$$Dm2=(1+v)*Dim \quad (1)$$

Figure 6:
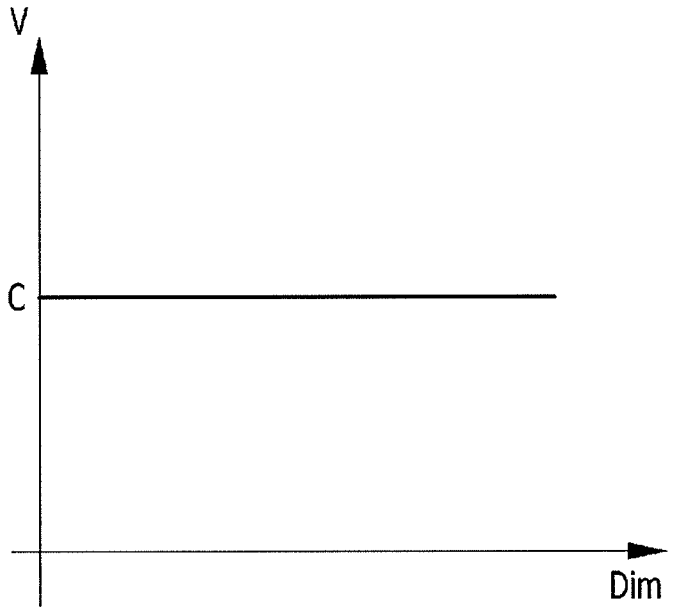
FIG. 6 illustrates a second example embodiment of the first measuring function.
Figure 7:
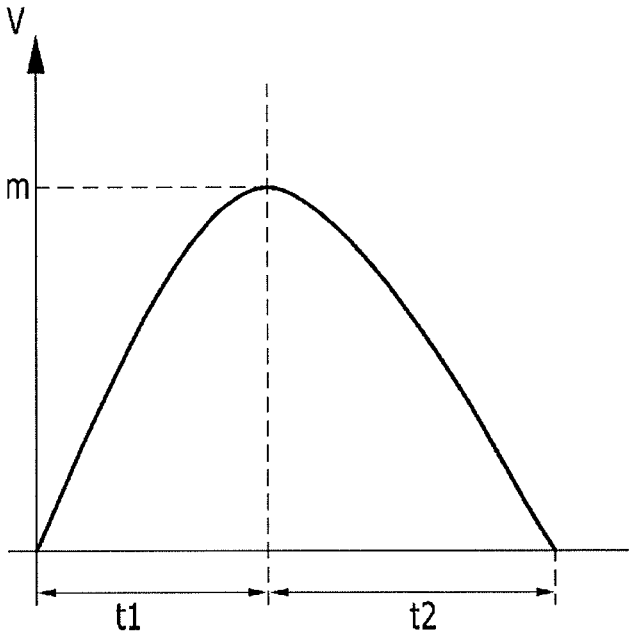
FIG. 7 illustrates a third example embodiment of the first measuring function.
Figure 8:
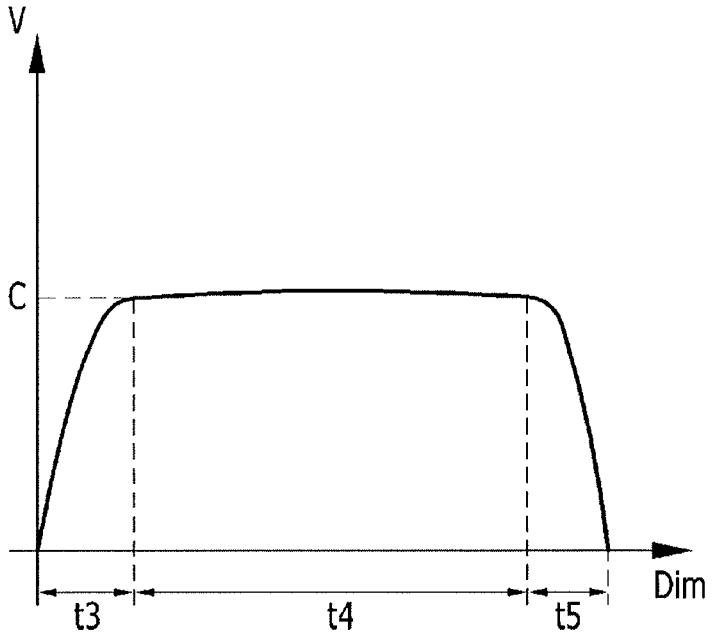
FIG. 8 illustrates a fourth example embodiment of the first measuring function.

The first measuring function v may be a constant value C regardless of the measurement image data signal Dim, as shown in FIG. 6. Alternatively, the first measuring function v may increase from 0 to a predetermined or maximum value m during period t1 and may decreased from the predetermined or maximum value m to 0 during period t2, as shown in FIG. 7. Alternatively, the first measuring function may increase during a period t3, remain constant C during a period t4, and decrease during period t5, as shown in FIG. 8.

The luminance compensator 614 generates a compensation image signal Dci1 for image signals R, G, and B based on the luminance value stored in the luminance memory 612. The compensation image data signals Dci1 may include predetermined default compensation data Dcd and measurement compensation data Dcm. The default compensation data Dcd may be a predetermined value, for example, 0, a maximum compensation value, half of the maximum compensation value, or an average of the measured luminance value stored in the luminance memory 612.

The measurement compensation data Dcm is determined based on a luminance value measured by luminance measurer 611. In one embodiment, the measured compensation data Dcm may have a measured maximum luminance value Lmax, a measured minimum luminance value Lmin, an average luminance value Lm of the display, measured luminance values Lx and Ly of at least any two areas (x and y indicate locations of central pixels of each of the areas), or a combination thereof. In one embodiment, the average value may be calculated based on an arithmetic mean, geometric mean, harmonic mean, or the like.

The luminance compensator 614 generates the compensation image data signal Dci1 based on Equation 2, and outputs this signal to sub-frame arranging unit 620.

$$Dci1=k*Dm1 \quad (2)$$

In Equation (2), k is a compensation data coefficient and, for example, may be a constant, a main data function, a measured value, or a combination thereof.

Figure 5:
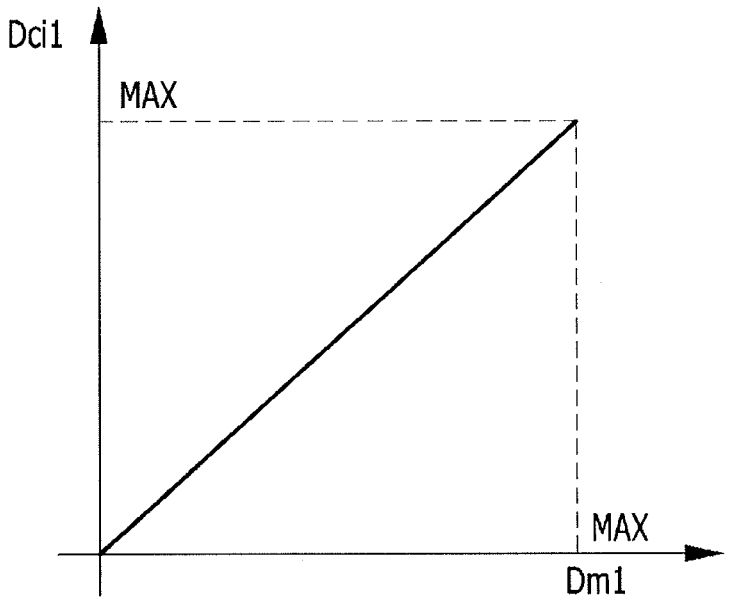
FIG. 5 illustrates a first example embodiment of a first measuring function.

As shown in FIG. 5, each of the compensation image data signals Dci1 may be proportional to main image data signal Dm1. For example, when main image data signal Dm1 is 0 (e.g., a black grayscale value), compensation image data signal Dci1 may be 0. When main image data signal Dm1 is maximized (R, G, and/or B grayscale values are maximized), compensation image data signal Dci1 may also be maximized.

The luminance compensator 614 may generate a compensation image data signal Dci2 based on Equation 3 during a compensation frame CF. The compensation image data signal Dci2 may be output to the sub-frame arranging unit 620.

$$Dci2=k*u*Dim \quad (3)$$

Figure 9:
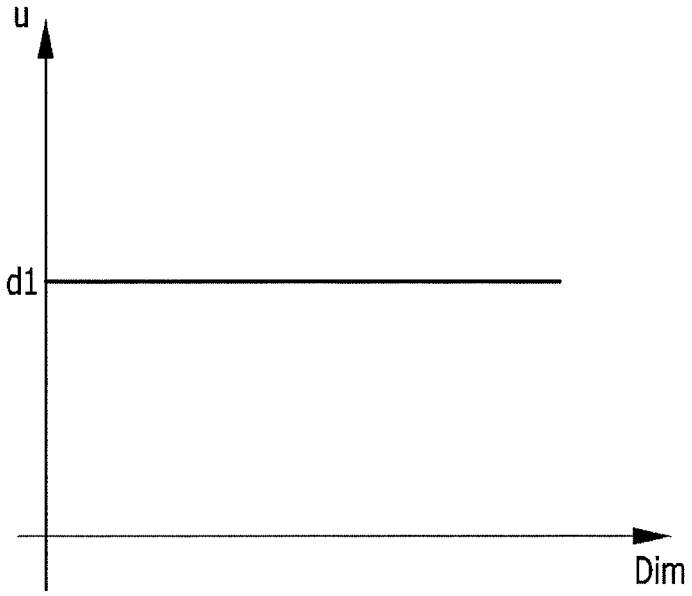
FIG. 9 illustrates a first example embodiment of a second measuring function.
Figure 10:
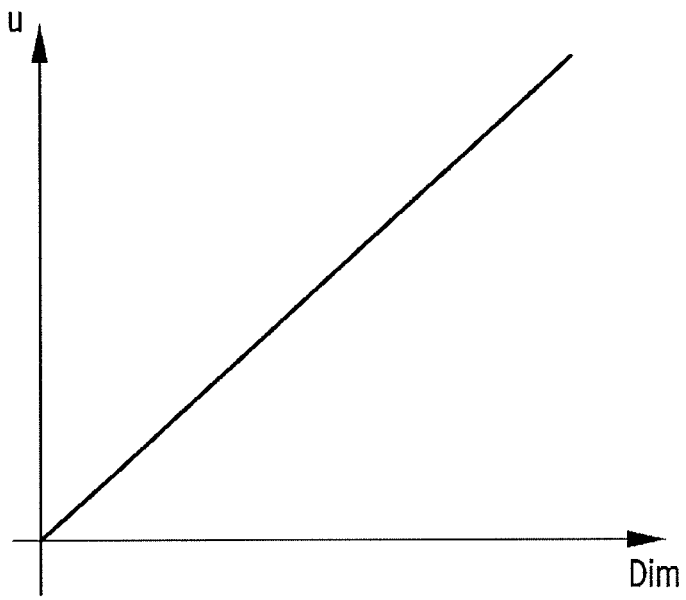
FIG. 10 illustrates a second example embodiment of the second measuring function.
Figure 11:
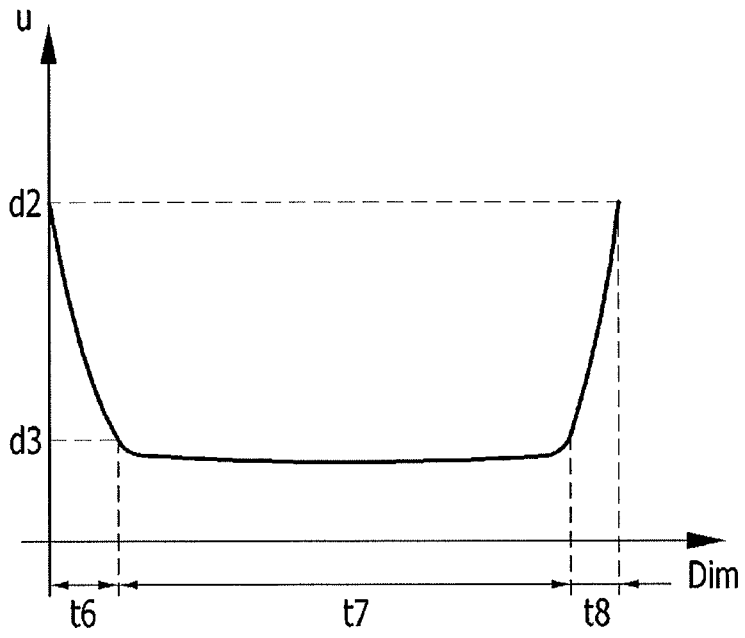
FIG. 11 illustrates a third example embodiment of the second measuring function.

In Equation 3, u is a second measuring function u. In Equation 3, second measuring function u may be a constant value d1 regardless of the measurement image data signal Dim (e.g., as shown in FIG. 9), may increase in proportion to measurement image data signal Dim (as shown in FIG. 10), or may decrease from a predetermined or maximum value d2 to a constant value d3 during a period t6, maintain a constant value (e.g., at or near d3) during a period t7, and increase from the constant value to a predetermined value (e.g., which may be maximum value d2 or a different value) during a period t8.

The sub-frame arranging unit 620 includes an image data signal generator 621 and a frame memory 622, to divide a frame into a main frame MF and a compensation frame CF. The frame memory 622 sequentially stores a main image data signal Dm1 or Dm2 and a compensation image data signal Dci1 or Dci2 of a previous frame, while the image data signal generator 621 forms a frame of current image signals R, G, and B.

The image data signal generator 621 forms the frame for current image signals R, G, and B using main frame MF, compensation frame CF, and blank frame BF of the current image signals R, G, and B stored in frame memory 622. The image data signal generator 621 arranges the main image data signal Dm1 or Dm2 corresponding to a period of the main frame MF, the compensation image data signal Dci1 or Dci2 corresponding to a period of the compensation frame CF, and the image data signal corresponding to a period of the blank frame BF, to generate output image data signal (Data) for output to the data driver 300.

Figure 12:
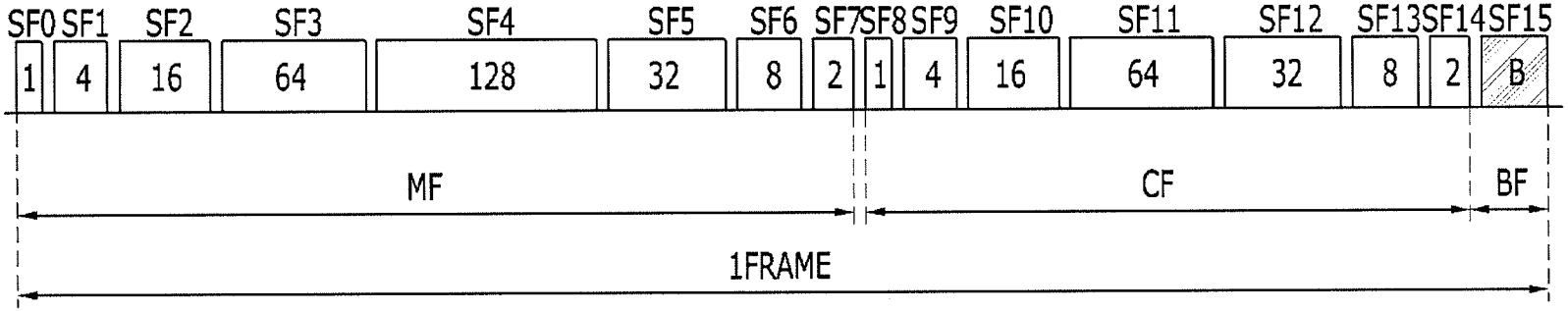
FIG. 12 illustrates a structure of sub-frames of a frame according to an embodiment of a first driving method.

FIG. 12 illustrates an example arrangement of sub-frames in a frame, which, for example, corresponds to a first driving method of a display device. The arrangement in FIG. 12 includes a main frame MF having a plurality of sub-frames, a compensation frame CF having a plurality of sub-frames, and a blank frame BF arranged in that order.

In main frame MF, sub-frames are arranged in order from a sub-frame SF0 to a sub-frame SF7. More specifically, the sub-frames in main frame MF may be arranged in an ascending order including sub-frame SF0 expressing 1 gray scale value, sub-frame SF1 expressing 4 gray scale values, sub-frame SF2 expressing 16 gray scale values, sub-frame SF3 expressing 64 gray scale values, sub-frame SF4 expressing 128 gray scale values, sub-frame SF5 expressing 32 gray scale values, sub-frame SF6 expressing 8 gray scale values, and sub-frame SF7 expressing 2 gray scale values.

In compensation frame CF, the sub-frames are arranged in order from sub-frame SF8 to sub-frame SF14. More specifically, the sub-frames in compensation frame CF are arranged in an ascending order from sub-frame SF8 expressing 1 gray scale value, sub-frame SF9 expressing 4 gray scale values, sub-frame SF10 expressing 16 gray scale values, sub-frame SF11 expressing 64 gray scale values, sub-frame SF12 32 gray scale values, and sub-frame SF14 expressing 2 gray scale values.

The blank frame BF may include a predetermined number of frames. In one embodiment, the blank frame may have one sub-frame SF15 to express, for example, a black gray scale value (e.g., 0 gray scale value). Each sub-frame displays a number corresponding to the gray scale value(s) expressed. The length of each sub-frame indicates its light-emitting time period.

Figure 13:
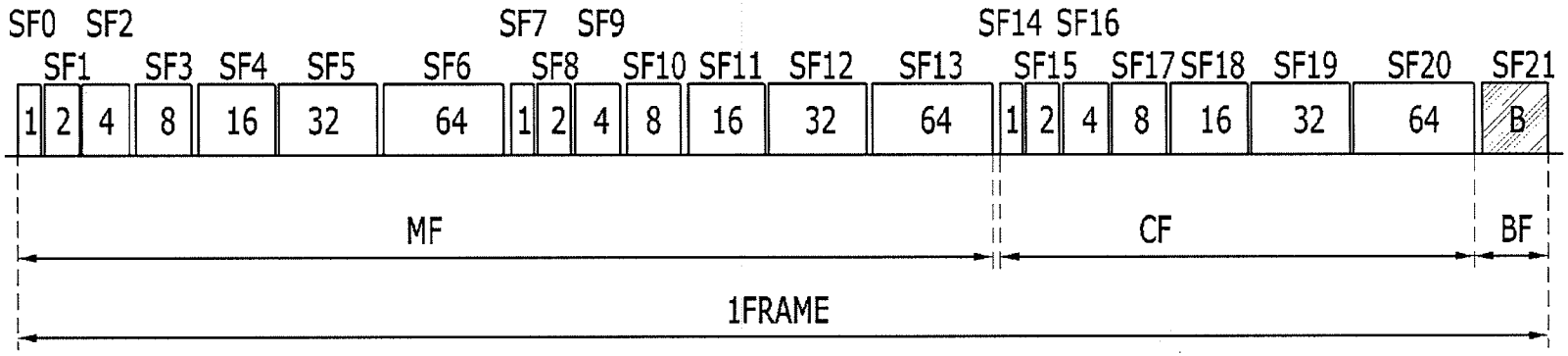
FIG. 13 illustrates a structure of sub-frames of a frame according to an embodiment of a second driving method.

FIG. 13 illustrates another arrangement of sub-frames of a frame, which, for example, may correspond to a second driving method of a display device. The sub-frames in FIG. 13 includes a main frame MF having a plurality of sub-frames, a compensation frame CF having a plurality of sub-frames, and a blank frame BF, arranged in that order.

In main frame MF, the sub-frames are arranged in order from a sub-frame SF0 to a sub-frame SF13. More specifically, the sub-frames may be arranged in an ascending order of sub-frame SF0 expressing 1 gray scale value, sub-frame SF1 expressing 2 gray scale values, sub-frame 2 SF2 expressing gray scale values, sub-frame SF3 expressing 8 gray scale values, sub-frame SF4 expressing 16 gray scale values, sub-frame SF5 expressing 32 gray scale values, sub-frame SF6 expressing 64 gray scale values, sub-frame SF7 expressing 1 gray scale value, sub-frame SF8 expressing 2 gray scale values, sub-frame SF9 expressing 4 gray scale values, sub-frame SF10 expressing 8 gray scale values, sub-frame SF11 expressing 16 gray scale values, sub-frame SF12 expressing 32 gray scale values, and sub-frame SF13 expressing 64 gray scale values.

In compensation frame CF, the sub-frames are arranged in order from a sub-frame SF14 to a sub-frame SF20. More specifically, the sub-frames are arranged in an ascending order of sub-frame SF14 expressing 1 gray scale value, sub-frame SF15 expressing 2 gray scale values, sub-frame SF16 expressing 4 gray scale values, sub-frame SF17 expressing 8 gray scale values, sub-frame SF18 expressing 16 gray scale values, sub-frame SF19 expressing 32 gray scale values, and sub-frame SF20 expressing 64 gray scale values.

The blank frame BF is located at a sub-frame SF21 and includes a predetermined number of sub-frames. In one embodiment, the blank frame has only one sub-frame to express, for example, a black gray scale value (e.g., 0 gray scale value). Each sub-frame displays a number corresponding to the gray scale values to be expressed. The length of each sub-frame indicates its light-emitting time period.

Figure 14:
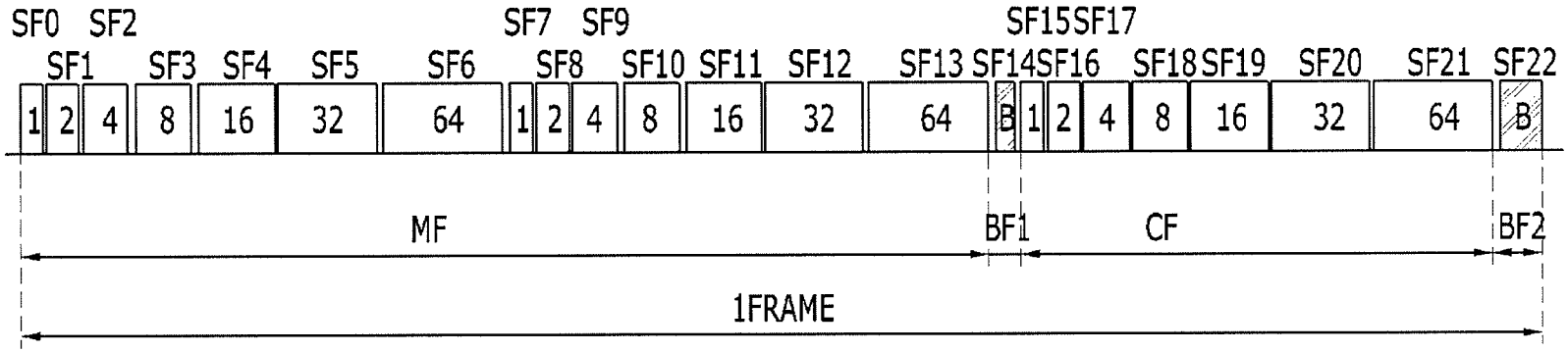
FIG. 14 illustrates a structure of sub-frames of a frame according to an embodiment of a third driving method.

FIG. 14 illustrates another example arrangement of sub-frames of a frame, which, for example, corresponds to a third driving method of a display device. This arrangement includes a main frame MF having a plurality of sub-frames, a first blank frame BF1, a compensation frame CF having a plurality of sub-frames, and a second blank frame BF2,*e* arranged in that order.

The main frame MF is arranged in order from a sub-frame SF0 to a sub-frame SF13. More specifically, the sub-frames are arranged in an ascending order of sub-frame SF0 expressing 1 gray scale value, sub-frame SF1 expressing 2 gray scale values, sub-frame 2 SF2 expressing 4 grayscales, sub-frame 3 SF3 expressing 8 grayscales, sub-frame 4 SF4 expressing 16 gray scale values, sub-frame SF5 expressing 32 gray scale values, sub-frame SF6 expressing 64 gray scale values, sub-frame SF7 expressing 1 gray scale value, sub-frame SF8 expressing 2 gray scale values, sub-frame SF9 expressing 4 gray scale values, sub-frame SF10 expressing 8 gray scale values, sub-frame SF11 expressing 16 gray scale values, sub-frame SF12 expressing 32 gray scale values, and sub-frame SF13 expressing 64 gray scale values.

The first blank frame BF1 is located at a sub-frame 14 SF14 to express a predetermined gray scale value, e.g., a black gray scale value of 0.

In compensation frame CF, the sub-frames are arranged in order from a sub-frame SF15 to a sub-frame SF21. More specifically, the sub-frames are arranged in an ascending order of sub-frame SF15 expressing 1 gray scale value, sub-frame SF16 expressing 2 gray scale values, sub-frame SF17 expressing 4 gray scale values, sub-frame SF18 expressing 8 gray scale values, sub-frame SF19 expressing 16 gray scale values, sub-frame SF20 expressing 32 gray scale values, and sub-frame SF21 expressing 64 gray scale values.

The second blank frame BF2 is located at a sub-frame 22 SF22 to express a predetermined gray scale value, e.g., a black gray scale value of 0. Each sub-frame displays a number corresponding to the gray scale values to be expressed. The length of each sub-frame indicates its light-emitting time period.

Figure 15:
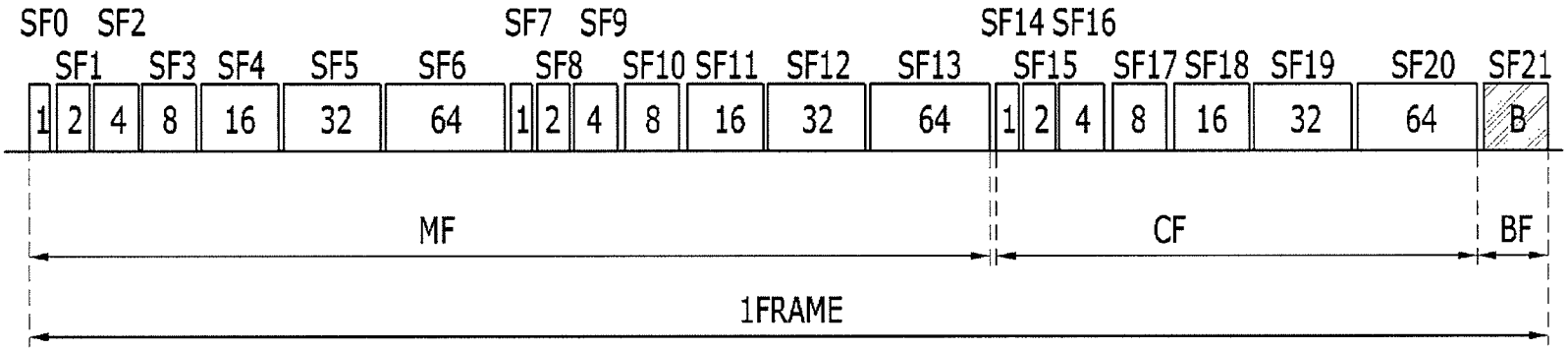
FIG. 15 illustrates a structure of sub-frames of a frame according to an embodiment of a fourth driving method.

FIG. 15 illustrates another example arrangement of sub-frames of a frame, which, for example, corresponds to a fourth driving method. The frame may include a main frame MF having a plurality of sub-frames, a compensation frame CF having a plurality of sub-frames, and a blank frame BF, arranged in that order.

In main frame MF, the sub-frames are arranged in order from a sub-frame SF0 to a sub-frame SF13. More specifically, the sub-frames are arranged in an ascending order of sub-frame SF0 expressing 1 gray scale value, sub-frame SF1 expressing 2 gray scale values, sub-frame SF2 expressing 4 gray scale values, sub-frame 3 SF3 expressing 8 gray scale values, sub-frame SF4 expressing 16 gray scale values, sub-frame SF5 expressing 32 gray scale values, sub-frame SF6 expressing 64 gray scale values, sub-frame SF7 expressing 1 gray scale value, sub-frame SF8 expressing 2 gray scale values, sub-frame SF9 expressing 4 gray scale values, sub-frame SF10 expressing 8 gray scale values, sub-frame SF11 expressing 16 gray scale values, sub-frame SF12 expressing 32 gray scale values, and sub-frame SF13 expressing 64 gray scale values.

In compensation frame CF, the sub-frames are arranged in order from a sub-frame SF14 to a sub-frame SF20. More specifically, the sub-frames are arranged in an ascending order of sub-frame SF14 expressing 1 gray scale value, sub-frame SF15 expressing 2 gray scale values, sub-frame SF16 expressing 4 gray scale values, sub-frame SF17 expressing 8 gray scale values, sub-frame SF18 expressing 16 gray scale values, sub-frame SF19 expressing 32 gray scale values, and sub-frame SF20 expressing 64 gray scale values.

The blank frame BF is located at a sub-frame SF21 to express a predetermined gray scale value, e.g., a black grayscale of 0. Each sub-frame displays a number corresponding to the grayscale values to be expressed, and the length of each sub-frame indicates its light-emitting time period.

Figure 16:
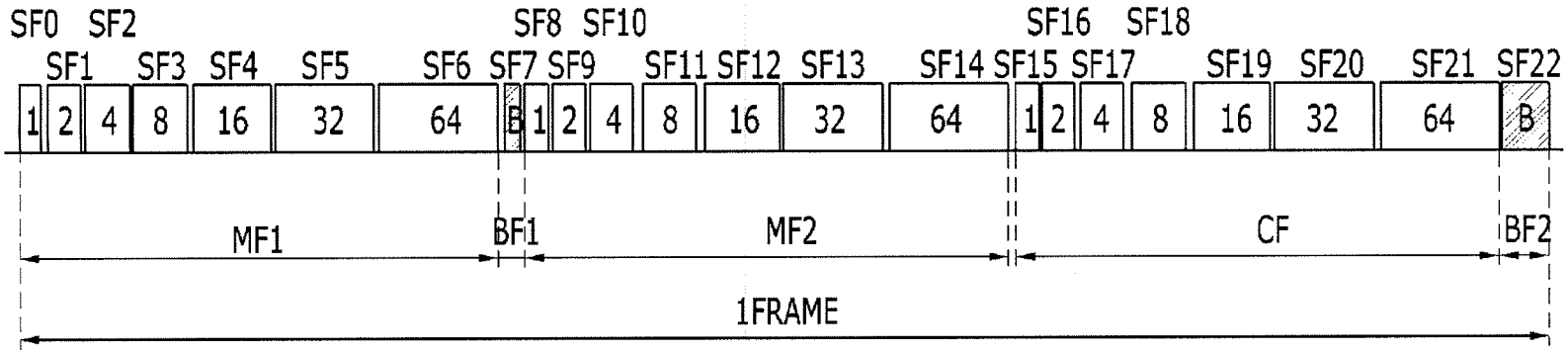
FIG. 16 illustrates a structure of sub-frames of a frame according to an embodiment of a fifth driving method.

FIG. 16 illustrates another example arrangement of sub-frames in a frame, which, for example, corresponds to a fifth driving method of a display device. This frame includes a first main frame MF1 having a plurality of sub-frames, a first blank frame BF1, a second main frame MF2 having a plurality of sub-frames, a compensation frame CF having a plurality of sub-frames, and a second blank frame BF2 are arranged in that order.

In first main frame MF1, the sub-frames are arranged in order from a sub-frame SF0 to a sub-frame SF6. More specifically, the sub-frames are arranged in an ascending order of sub-frame SF0 expressing 1 gray scale value, sub-frame SF1 expressing 2 gray scale values, sub-frame SF2 expressing 4 gray scale values, sub-frame SF3 expressing 8 gray scale values, sub-frame SF4 expressing 16 gray scale values, sub-frame SF5 expressing 32 gray scale values, and sub-frame SF6 expressing 64 gray scale values.

In second main frame MF2, the sub-frames are arranged in order from a sub-frame SF8 to a sub-frame SF14. More specifically, the sub-frames are in an ascending order of sub-frame SF8 expressing 1 gray scale value, sub-frame SF9 expressing 2 gray scale values, sub-frame SF10 expressing 4 gray scale values, sub-frame SF11 expressing 8 gray scale values, sub-frame SF12 expressing 16 gray scale values, sub-frame SF13 expressing 32 gray scale values, and sub-frame SF14 expressing 64 gray scale values.

The first blank frame BF1 is located at a sub-frame SF7 to express a predetermined gray scale value, e.g., a black grayscale of 0.

In compensation frame CF, the sub-frames are arranged in order from a sub-frame SF15 to a sub-frame SF21 More specifically, the sub-frames are arranged in an ascending order of sub-frame SF15 expressing 1 gray scale value, sub-frame SF16 expressing 2 gray scale values, sub-frame SF17 expressing 4 gray scale values, sub-frame SF18 expressing 8 gray scale values, sub-frame SF19 expressing 16 gray scale values, sub-frame SF20 expressing 32 gray scale values, and sub-frame SF21 expressing 64 gray scale values.

The second blank frame BF2 is located at a sub-frame 22 SF22 to express a predetermined gray scale value, e.g., a black grayscale of value 0. Each sub-frame displays a number corresponding to gray scale values to be expressed. The length of each sub-frame indicates its light-emitting time period.

Figure 17:
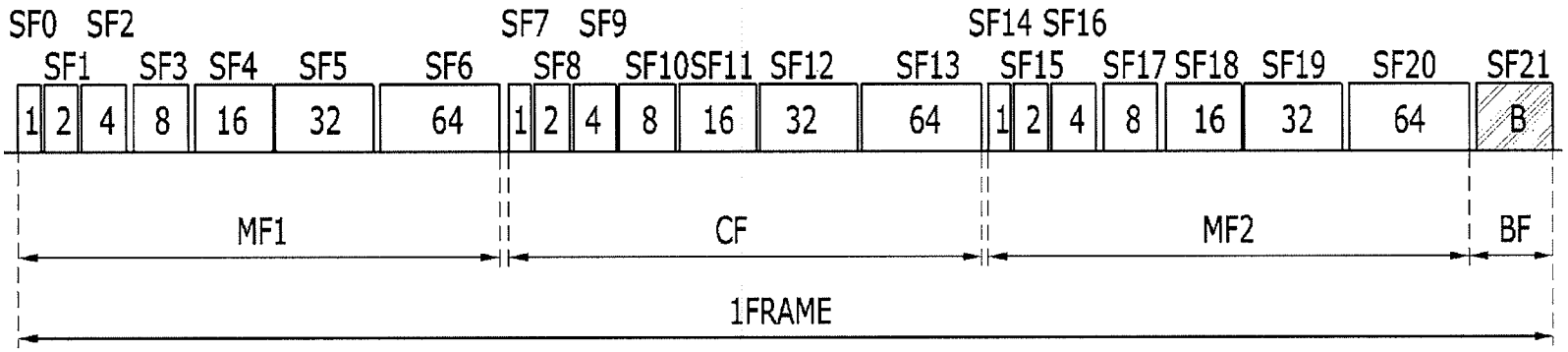
FIG. 17 illustrates a structure of sub-frames of a frame according to an embodiment of a sixth driving method.

FIG. 17 illustrates another example arrangement of sub-frames in a frame, which, for example, corresponds to a sixth driving method of a display device. This arrangement includes a first main frame MF1 having a plurality of sub-frames, a compensation frame CF having a plurality of sub-frames, a second main frame MF2 having a plurality of sub-frames, and a blank frame BF, arranged in that order.

In first main frame MF1, the sub-frames are arranged in order from a sub-frame SF0 to a sub-frame SF6. More specifically, the sub-frames are arranged in an ascending order of sub-frame SF0 expressing 1 gray scale value, sub-frame SF1 expressing 2 gray scale values, sub-frame SF2 expressing 4 gray scale values, sub-frame SF3 expressing 8 gray scale values, sub-frame SF4 expressing 16 gray scale values, sub-frame SF5 expressing 32 gray scale values, and sub-frame SF6 expressing 64 gray scale values.

In compensation frame CF, the sub-frames are arranged in order from a sub-frame SF7 to a sub-frame SF13. More specifically, the sub-frames are arranged in an ascending order of sub-frame SF7 expressing 1 gray scale values, sub-frame SF8 expressing 2 gray scale values, sub-frame SF9 expressing 4 gray scale values, sub-frame SF10 expressing 8 gray scale values, sub-frame SF11 expressing 16 gray scale values, sub-frame SF12 expressing 32 gray scale values, and sub-frame SF13 expressing 64 gray scale values.

In second main frame MF2 the sub-frames are arranged in order from a sub-frame SF14 to a sub-frame SF20. More specifically, the sub-frames are arranged in an ascending order of sub-frame SF14 expressing 1 gray scale value, sub-frame SF15 expressing 2 gray scale values, sub-frame SF16 expressing 4 gray scale values, sub-frame SF17 expressing 8 gray scale values, sub-frame SF18 expressing 16 gray scale values, sub-frame SF19 expressing 32 gray scale values, and sub-frame SF20 expressing 64 gray scale values.

The blank frame BF is located at a sub-frame SF21 to express a predetermined gray scale value, e.g., a black grayscale of 0. Each sub-frame displays a number corresponding to the gray scale values to be expressed. The length of each sub-frame indicates its light-emitting time period.

Figure 18:
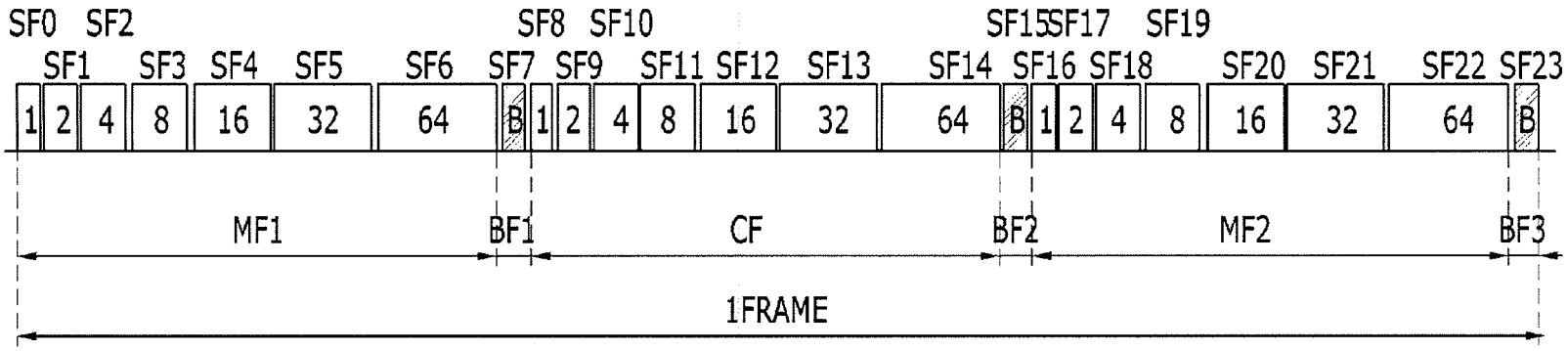
FIG. 18 illustrates a structure of sub-frames of a frame according to an embodiment of a seventh driving method.

FIG. 18 illustrates another example arrangement of sub-frames of a frame, which, for example, corresponds to a seventh driving method of a display device. The arrangement includes a first main frame MF1 having a plurality of sub-frames, a first blank frame BF1, a compensation frame CF having a plurality of sub-frames, a second blank frame BF2, a second main frame MF2 having a plurality of sub-frames, and a third blank frame BF3 are arranged in that order.

In first main frame MF1, the sub-frames are arranged in order from a sub-frame SF0 to a sub-frame SF6, More specifically, the sub-frames are arranged in an ascending order of sub-frame SF0 expressing 1 gray scale value, sub-frame SF1 expressing 2 gray scale values, sub-frame SF2 expressing 4 gray scale values, sub-frame SF3 expressing 8 gray scale values, sub-frame SF4 expressing 16 gray scale values, sub-frame SF5 expressing 32 gray scale values, and sub-frame SF6 expressing 64 gray scale values.

The first blank frame BF1 is located at a sub-frame 7 SF7 to express a predetermined gray scale value, e.g., a black grayscale of 0.

In compensation frame CF, the sub-frames are arranged in order from a sub-frame SF8 to a sub-frame SF14. More specifically, the sub-frames are arranged in an ascending order of sub-frame SF8 expressing 1 gray scale value, a sub-frame SF9 expressing 2 gray scale values, sub-frame SF10 expressing 4 gray scale values, sub-frame SF11 expressing 8 gray scale values, sub-frame SF12 expressing 16 gray scale values, sub-frame SF13 expressing 32 gray scale values, and sub-frame SF14 expressing 64 gray scale values.

The second blank frame BF2 is located at a sub-frame 15 SF15 to express a predetermined gray scale value, e.g., a black gray scale value of 0.

In second main frame MF2, the sub-frames are arranged in order from a sub-frame SF16 to a sub-frame SF22. More specifically, the sub-frames are arranged in an ascending order of sub-frame SF16 expressing 1 gray scale value, sub-frame SF17 expressing 2 gray scale values, sub-frame SF18 expressing 4 gray scale values, sub-frame SF19 expressing 8 gray scale values, sub-frame SF20 expressing 16 gray scale values, sub-frame SF21 expressing 32 gray scale values, and sub-frame SF22 expressing 64 gray scale values.

The third blank frame BF3 is located at a sub-frame 23 SF23 to express a predetermined gray scale value, e.g., a black grayscale of 0.

Figure 19:
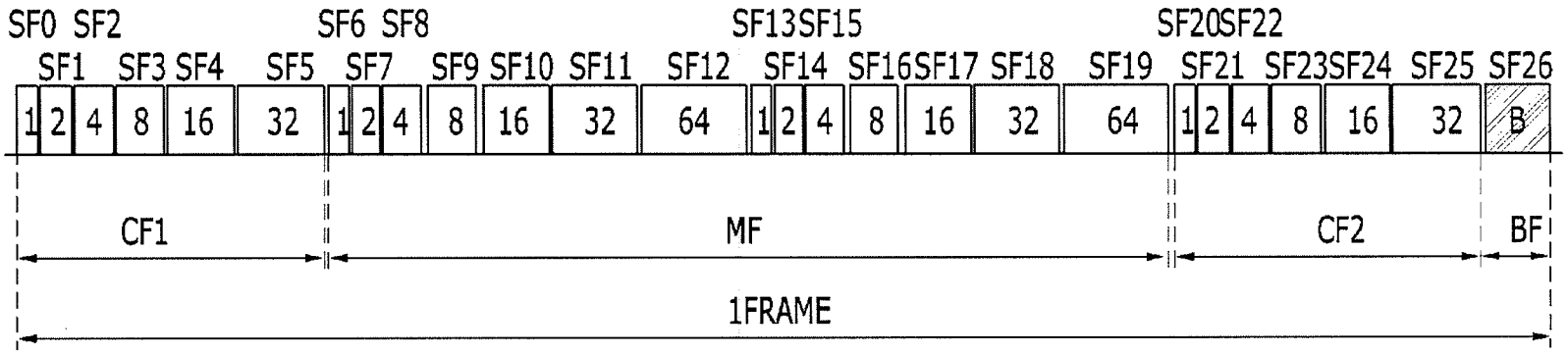
FIG. 19 illustrates a structure of sub-frames of a frame according to an embodiment of an eighth driving method.

FIG. 19 illustrates an example arrangement of sub-frames of a frame, which, for example, corresponds to an eighth driving method of a display device. The arrangement includes a first compensation frame CF1 having a plurality of sub-frames, a main frame MF having a plurality of sub-frames, a second compensation frame CF2 having a plurality of sub-frames, and a blank frame BF, arranged in that order.

In first compensation frame CF, the sub-frames are arranged in order from a sub-frame SF0 to a sub-frame SF5. More specifically, the sub-frames are arranged in an ascending order of sub-frame SF0 expressing 1 gray scale value, sub-frame SF1 expressing 2 gray scale values, sub-frame SF2 expressing 4 gray scale values, sub-frame SF3 expressing 8 gray scale values, sub-frame SF4 expressing 16 gray scale values, and sub-frame SF5 expressing 32 gray scale values.

In main frame MF, the sub-frames are arranged in order from a sub-frame SF6 to a sub-frame SF19. More specifically, the sub-frames are arranged in an ascending order of sub-frame SF6 expressing 1 gray scale value, sub-frame SF7 expressing 2 gray scale values, sub-frame SF8 expressing 4 gray scale values, sub-frame SF9 expressing 8 gray scale values, sub-frame SF10 expressing 16 gray scale values, sub-frame SF11 expressing 32 gray scale values, sub-frame SF12 expressing 64 gray scale values, sub-frame SF13 expressing 1 gray scale value, sub-frame SF14 expressing 2 gray scale values, sub-frame SF15 expressing 4 gray scale values, sub-frame SF16 expressing 8 gray scale values, sub-frame SF17 expressing 16 gray scale values, sub-frame SF18 expressing 32 gray scale values, and sub-frame SF19 expressing 64 gray scale values.

In second compensation frame CF2, the sub-frames are arranged in order from a sub-frame SF20 to a sub-frame SF25. More specifically, the sub-frames are arranged in an ascending order of sub-frame SF20 expressing 1 gray scale value, sub-frame SF21 expressing 2 gray scale values, sub-frame SF22 expressing 4 gray scale values, sub-frame SF23 expressing 8 gray scale values, sub-frame SF24 expressing 16 gray scale values, and sub-frame SF25 expressing 32 gray scale values.

The blank frame BF is located at a sub-frame 26 SF26 to express a predetermined gray scale value, e.g., a black grayscale of 0.

Figure 20:
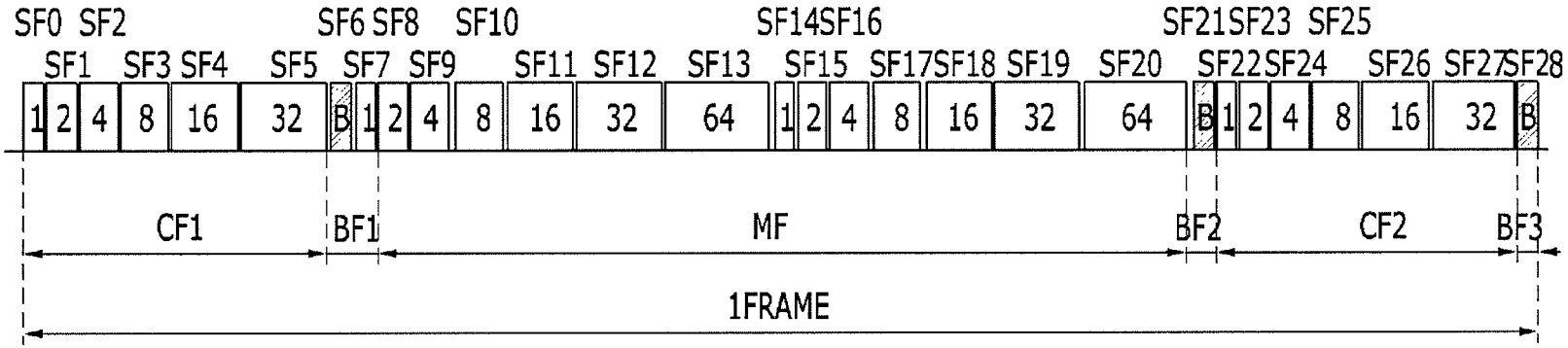
FIG. 20 illustrates a structure of sub-frames of a frame according to an embodiment of a ninth driving method.

FIG. 20 illustrates an example arrangement of a sub-frames of a frame, which, for example, corresponds to a ninth driving method of a display device. The arrangement includes a first compensation frame CF1 having a plurality of sub-frames, a first blank frame BF1, a main frame MF having a plurality of sub-frames, a second blank frame BF2, a second compensation frame CF2 having a plurality of sub-frames, and a third blank frame BF3 are arranged in that order.

In first compensation frame CF, the sub-frames are arranged in order from a sub-frame SF0 to a sub-frame SF5. More specifically, the sub-frames are arranged in an ascending order of sub-frame SF0 expressing 1 gray scale value, sub-frame SF1 expressing 2 gray scale values, sub-frame SF2 expressing 4 gray scale values, sub-frame SF3 expressing 8 gray scale values, sub-frame SF4 expressing 16 gray scale values, and sub-frame SF5 expressing 32 gray scale values.

The first blank frame BF1 is located at a sub-frame 6 SF6 to express a predetermined gray scale value, e.g., a black grayscale of 0.

In main frame MF, the sub-frames are arranged in order from a sub-frame SF7 to a sub-frame SF20. More specifically, the sub-frames are arranged in an ascending order of sub-frame SF7 expressing 1 gray scale value, sub-frame SF8 expressing 2 gray scale values, sub-frame SF9 expressing 4 gray scale values, sub-frame SF10 expressing 8 gray scale values, sub-frame SF11 expressing 16 gray scale values, sub-frame SF12 expressing 32 gray scale values, sub-frame SF13 expressing 64 gray scale values, sub-frame SF14 expressing 1 gray scale value, sub-frame SF15 expressing 2 gray scale values, sub-frame SF16 expressing 4 gray scale values, sub-frame SF17 expressing 8 gray scale values, sub-frame SF18 expressing 16 gray scale values, sub-frame SF19 expressing 32 gray scale values, and sub-frame SF20 expressing 64 gray scale values.

The second blank frame BF2 is located at a sub-frame 21 SF21 to express a predetermined gray scale value, e.g., a black grayscale of 0.

In second compensation frame CF2, the sub-frames are arranged in order from a sub-frame SF22 to a sub-frame SF27. More specifically, the sub-frames are arranged in an ascending order of sub-frame SF22 expressing 1 gray scale value, sub-frame SF23 expressing 2 gray scale values, sub-frame SF24 expressing 4 gray scale values, sub-frame SF25 expressing 8 gray scale values, sub-frame SF26 expressing 16 gray scale values, and sub-frame SF27 expressing 32 gray scale values.

The third blank frame BF3 is located at a sub-frame 28 SF28 to express a predetermined gray scale value, e.g., a black grayscale of 0.

Figure 21:
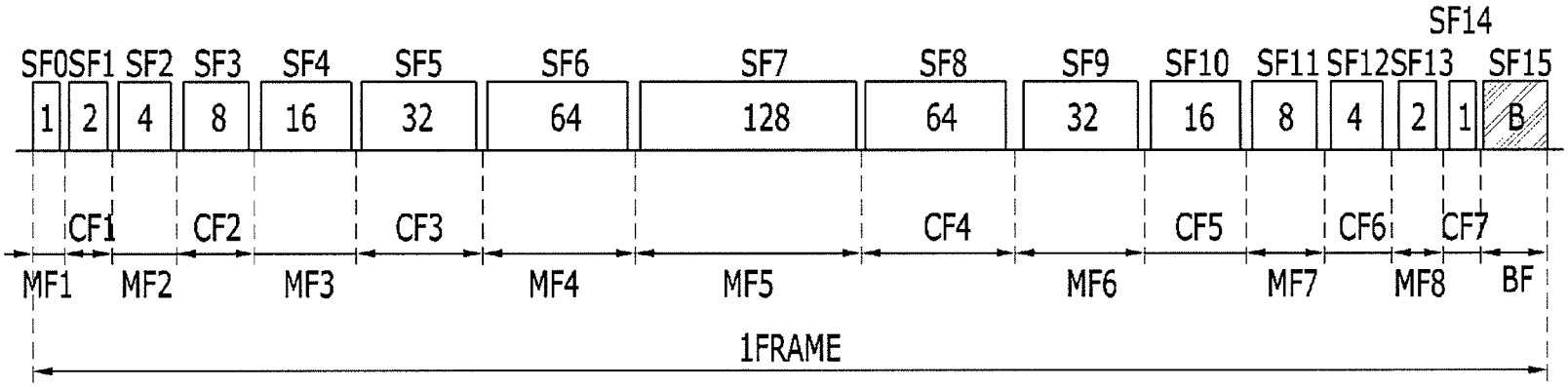
FIG. 21 illustrates a structure of sub-frames of a frame according to an embodiment of a tenth driving method.

FIG. 21 illustrates an example arrangement of sub-frames of a frame, which, for example, a tenth driving method of a display device. For an arrangement of one frame constituted by the sub-frames shown in FIG. 21 in accordance with the ninth driving method, a plurality of sub-frames constituting a main frame MF and a plurality of sub-frames constituting a compensation frame CF are mixedly arranged.

The first main frame MF1 expresses 1 gray scale value, a first compensation frame CF1 expresses 2 gray scale values, a second main frame MF2 expresses 4 gray scale values, a second compensation frame CF2 expresses 8 gray scale values, a third main frame MF3 expresses 16 gray scale values, a third compensation frame CF3 expresses 32 gray scale values, a fourth main frame MF4 expresses 64 gray scale values, a fifth main frame MF5 expresses 128 gray scale values, a fourth compensation frame CF4 expresses 64 gray scale values, a sixth main frame MF6 expresses 32 gray scale values, a fifth compensation frame CF5 expresses 16 gray scale values, a seventh main frame MF7 expresses 8 gray scale values, a sixth compensation frame CF6 expresses 4 gray scale values, an eighth main frame MF8 expresses 2 gray scale values, and a seventh compensation frame CF7 expresses 1 gray scale value are respectively arranged at a sub-frame SF0, sub-frame SF1, sub-frame SF2, sub-frame SF3, sub-frame SF4, sub-frame SF5, sub-frame SF6, sub-frame SF7, sub-frame SF8, sub-frame SF9, sub-frame SF10, sub-frame SF11, sub-frame SF12, sub-frame SF13, and sub-frame SF14.

The blank frame BF is located at a sub-frame SF15 to express a predetermined gray scale value, e.g., a black grayscale of 0.

By way of summation and review, one or more of the aforementioned embodiments provide a display device and a driving method which compensate luminance non-uniformity caused, for example, by voltage drops or different threshold voltages of the organic light emitting diodes (OLEDs) in the display pixels.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display including a plurality of pixels; and a timing controller to form a frame of an image signal based on a main frame, a compensation frame, and at least one blank frame, and to determine a driving method of each of the pixels to generate output image data, wherein the main frame serves to display the image signal, the compensation frame serves to compensate a luminance of the main frame, and the blank frame serves to express a black gray scale value.

2. The display device as claimed in claim 1, wherein the timing controller includes a sub-frame controller which includes:

a luminance measurer to measure a luminance value of at least one area of the display;

a sub-frame generator to convert the image signal into a main image data signal; and a luminance compensator to generate a compensation image data signal to compensate luminance according to the image signal based on the measured luminance value.

3. The display device as claimed in claim 2, wherein:

the timing controller further includes a sub-frame arranger, the sub-frame arranger forms a frame of the image signal based on the main frame, the compensation frame, and the blank frame, and the sub-frame arranger generates an output image data signal based on arranging the main image data signal corresponding to a period of the main frame, the compensation image data signal corresponding to a period of the compensation frame, and an image data signal corresponding to a period of the blank frame.

4. The display device as claimed in claim 3, wherein:

the frame of the image signal includes a main frame, a compensation frame, and a blank frame arranged in that order, each of the main frame and the compensation frame includes a plurality of sub-frames, the main frame includes sub-frames having weight values of grayscale 1, grayscale 4, grayscale 16, grayscale 64, grayscale 128, grayscale 32, grayscale 8, and grayscale 2 which are successively arranged, and the compensation frame includes sub-frames having weight values of grayscale 1, grayscale 4, grayscale 16, grayscale 64, grayscale 128, grayscale 32, grayscale 8, and grayscale 2 which are successively arranged.

5. The display device as claimed in claim 3, wherein:

the frame of the image signal includes a main frame, a compensation frame, and a blank frame arranged in that order, each of the main frame and the compensation frame includes a plurality of sub-frames, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame includes sub-frames having weight values of grayscale 1, grayscale 2, grayscale 4, grayscale 8, grayscale 16, grayscale 32, and grayscale 64 which are successively arranged.

6. The display device as claimed in claim 3, wherein:

the frame of the image signal includes a main frame, a first blank frame, a compensation frame, and a second blank frame arranged in that order, each of the main frame and the compensation frame includes a plurality of sub-frames, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame includes sub-frames having weight values of grayscale 1, grayscale 2, grayscale 4, grayscale 8, grayscale 16, grayscale 32, and grayscale 64 which are successively arranged.

7. The display device as claimed in claim 3, wherein:

the frame of the image signal includes a main frame, a compensation frame, and a blank frame arranged in that order, each of the main frame and the compensation frame includes a plurality of sub-frames, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame includes sub-frames having weight values of grayscale 1, grayscale 2, grayscale 4, grayscale 8, grayscale 16, grayscale 32, and grayscale 64 which are successively arranged.

8. The display device as claimed in claim 3, wherein:

the frame of the image signal includes a main frame having a first blank frame, a compensation frame, and a second blank frame arranged in that order, each of the main frame and the compensation frame includes a plurality of sub-frames, the main frame includes sub-frames having weight values of grayscale 1, grayscale 2, grayscale 4, grayscale 8, grayscale 16, grayscale 32, grayscale 64, grayscale 0, grayscale 1, grayscale 2, grayscale 4, grayscale 8, grayscale 16, grayscale 32, and grayscale 64 which are successively arranged, and the compensation frame includes sub-frames having weight values of grayscale 1, grayscale 2, grayscale 4, grayscale 8, grayscale 16, grayscale 32, and grayscale 64 which are successively arranged.

9. The display device as claimed in claim 3, wherein:

the frame of the image signal includes a first main frame, a compensation frame, a second main frame, and a blank frame arranged in that order, each of the first main frame, the compensation frame, and the second main frame includes a plurality of sub-frames, the first main frame includes sub-frames having weight values of grayscale 1, grayscale 2, grayscale 4, grayscale 8, grayscale 16, grayscale 32, and grayscale 64 which are successively arranged, the compensation frame includes sub-frames having weight values of grayscale 1, grayscale 2, grayscale 4, grayscale 8, grayscale 16, grayscale 32, and grayscale 64 which are successively arranged, and the second main frame includes sub-frames having weight values of grayscale 1, grayscale 2, grayscale 4, grayscale 8, grayscale 16, grayscale 32, and grayscale 64 which are successively arranged.

10. The display device as claimed in claim 3, wherein:

the frame of the image signal includes a first main frame, a first blank frame, a compensation frame, a second blank frame, a second main frame, and a third blank frame arranged in that order, each of the first main frame, the compensation frame, and the second main frame includes a plurality of sub-frames, the first main frame includes sub-frames having weight values of grayscale 1, grayscale 2, grayscale 4, grayscale 8, grayscale 16, grayscale 32, and grayscale 64 which are successively arranged, the compensation frame includes sub-frames having weight values of grayscale 1, grayscale 2, grayscale 4, grayscale 8, grayscale 16, grayscale 32, and grayscale 64 which are successively arranged, and the second main frame includes sub-frames having weight values of grayscale 1, grayscale 2, grayscale 4, grayscale 8, grayscale 16, grayscale 32, and grayscale 64 which are successively arranged.

11. The display device as claimed in claim 3, wherein:

the frame of the image signal includes a first compensation frame, a main frame, a second compensation frame, and a blank frame arranged in that order, each of the first main frame, the compensation frame, and the second main frame includes a plurality of sub-frames, the first compensation frame includes sub-frames having weight values of grayscale 1, grayscale 2, grayscale 4, grayscale 8, grayscale 16, and grayscale 32 which are successively arranged, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the second compensation frame includes sub-frames having weight values of grayscale 1, grayscale 2, grayscale 4, grayscale 8, grayscale 16, and grayscale 32 which are successively arranged.

12. The display device as claimed in claim 3, wherein:

the frame of the image signal includes a first compensation frame, a first blank frame, a main frame, a second blank frame, a second compensation frame, and a third blank frame arranged in that order, each of the first compensation frame, the main frame, and the second compensation frame includes a plurality of sub-frames, the first compensation frame includes sub-frames having weight values of grayscale 1, grayscale 2, grayscale 4, grayscale 8, grayscale 16, and grayscale 32 which are successively arranged, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the second compensation frame includes sub-frames having weight values of grayscale 1, grayscale 2, grayscale 4, grayscale 8, grayscale 16, and grayscale 32 which are successively arranged.

13. The display device as claimed in claim 3, wherein:

each of the main frame and the compensation frame includes a plurality of sub-frames, and the frame of the image signal includes a first main frame of grayscale 1, a first compensation frame of grayscale 2, a second main frame of grayscale 4, a second compensation frame of grayscale 8, a third main frame of grayscale 16, a third compensation frame of grayscale 32, a fourth main frame of grayscale 64, a fifth main frame of grayscale 128, a fourth compensation frame of grayscale 64, a sixth main frame of grayscale 32, a fifth compensation frame of grayscale 16, a seventh main frame of grayscale 8, a sixth compensation frame of grayscale 4, an eighth main frame of grayscale 2, a seventh compensation frame of grayscale 1, and a blank frame arranged in that order.

14. A method of driving a display device, the driving method comprising:

measuring a luminance value of at least one area of a display;

converting the image signal into a main image data signal;

generating a compensation image data signal for compensating luminance according to the image signal based on the measured luminance value; and forming a frame of the image signal based on a main frame, a compensation frame, and a blank frame.

15. The driving method as claimed in claim 14, wherein the forming the frame of the image signal includes:

generating an output image data signal by arranging the main image data signal corresponding to a period of the main frame, the compensation image data signal corresponding to a period of the compensation frame, and an image data signal corresponding to a period of the blank frame.

16. The driving method as claimed in claim 15, wherein:

the frame of the image signal includes a main frame, a compensation frame, and a blank frame arranged in that order, each of the main frame and the compensation frame includes a plurality of sub-frames, the main frame includes sub-frames having weight values of grayscale 1, grayscale 4, grayscale 16, grayscale 64, grayscale 128, grayscale 32, grayscale 8, and grayscale 2 which are successively arranged, and the compensation frame includes sub-frames having weight values of grayscale 1, grayscale 4, grayscale 16, grayscale 64, grayscale 128, grayscale 32, grayscale 8, and grayscale 2 which are successively arranged.

17. The driving method as claimed in claim 15, wherein:

the frame of the image signal includes a main frame, a compensation frame, and a blank frame arranged in that order, each of the main frame and the compensation frame includes a plurality of sub-frames, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame includes sub-frames having weight values of grayscale 1, grayscale 2, grayscale 4, grayscale 8, grayscale 16, grayscale 32, and grayscale 64 which are successively arranged.

18. The driving method as claimed in claim 15, wherein:

the frame of the image signal includes a main frame, a first blank frame, a compensation frame, and a second blank frame arranged in that order, each of the main frame and the compensation frame includes a plurality of sub-frames, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame includes sub-frames having weight values of grayscale 1, grayscale 2, grayscale 4, grayscale 8, grayscale 16, grayscale 32, and grayscale 64 which are successively arranged.

19. The driving method as claimed in claim 15, wherein:

the frame of the image signal includes a main frame, a compensation frame, and a blank frame arranged in that order, each of the main frame and the compensation frame includes a plurality of sub-frames, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the compensation frame includes sub-frames having weight values of grayscale 1, grayscale 2, grayscale 4, grayscale 8, grayscale 16, grayscale 32, and grayscale 64 which are successively arranged.

20. The driving method as claimed in claim 15, wherein:

the frame of the image signal includes a main frame having a first blank frame, a compensation frame, and a second blank frame arranged in that order, each of the main frame and the compensation frame includes a plurality of sub-frames, the main frame includes sub-frames having weight values of grayscale 1, grayscale 2, grayscale 4, grayscale 8, grayscale 16, grayscale 32, grayscale 64, grayscale 0, grayscale 1, grayscale 2, grayscale 4, grayscale 8, grayscale 16, grayscale 32, and grayscale 64 which are successively arranged, and the compensation frame includes sub-frames having weight values of grayscale 1, grayscale 2, grayscale 4, grayscale 8, grayscale 16, grayscale 32, and grayscale 64 which are successively arranged.

21. The driving method as claimed in claim 15, wherein:

the frame of the image signal includes a first main frame, a compensation frame, a second main frame, and a blank frame arranged in that order, each of the first main frame, the compensation frame, and the second main frame includes a plurality of sub-frames, the first main frame includes sub-frames having weight values of grayscale 1, grayscale 2, grayscale 4, grayscale 8, grayscale 16, grayscale 32, and grayscale 64 which are successively arranged, the compensation frame includes sub-frames having weight values of grayscale 1, grayscale 2, grayscale 4, grayscale 8, grayscale 16, grayscale 32, and grayscale 64 which are successively arranged, and the second main frame includes sub-frames having weight values of grayscale 1, grayscale 2, grayscale 4, grayscale 8, grayscale 16, grayscale 32, and grayscale 64 which are successively arranged.

22. The driving method as claimed in claim 15, wherein;

the frame of the image signal includes a first main frame, a first blank frame, a compensation frame, a second blank frame, a second main frame, and a third blank frame arranged in that order, each of the first main frame, the compensation frame, and the second main frame includes a plurality of sub-frames, the first main frame includes sub-frames having weight values of grayscale 1, grayscale 2, grayscale 4, grayscale 8, grayscale 16, grayscale 32, and grayscale 64 which are successively arranged, the compensation frame includes sub-frames having weight values of grayscale 1, grayscale 2, grayscale 4, grayscale 8, grayscale 16, grayscale 32, and grayscale 64 which are successively arranged, and the second main frame includes sub-frames having weight values of grayscale 1, grayscale 2, grayscale 4, grayscale 8, grayscale 16, grayscale 32, and grayscale 64 which are successively arranged.

23. The driving method as claimed in claim 15, wherein:

the frame of the image signal includes a first compensation frame, a main frame, a second compensation frame, and a blank frame arranged in that order, each of the first main frame, the compensation frame, and the second main frame includes a plurality of sub-frames, the first compensation frame includes sub-frames having weight values of grayscale 1, grayscale 2, grayscale 4, grayscale 8, grayscale 16, and grayscale 32 which are successively arranged, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the second compensation frame includes sub-frames having weight values of grayscale 1, grayscale 2, grayscale 4, grayscale 8, grayscale 16, and grayscale 32 which are successively arranged.

24. The driving method as claimed in claim 15, wherein:

the frame of the image signal includes a first compensation frame, a first blank frame, a main frame, a second blank frame, a second compensation frame, and a third blank frame arranged in that order, each of the first compensation frame, the main frame, and the second compensation frame includes a plurality of sub-frames, the first compensation frame includes sub-frames having weight values of grayscale 1, grayscale 2, grayscale 4, grayscale 8, grayscale 16, and grayscale 32 which are successively arranged, the main frame includes sub-frames having weight values of grayscale 1, grayscale 2, grayscale 4, grayscale 8, grayscale 16, grayscale 32, grayscale 64, grayscale 1, grayscale 2, grayscale 4, grayscale 8, grayscale 16, grayscale 32, and grayscale 64 which are successively arranged, and the second compensation frame includes sub-frames having weight values of grayscale 1, grayscale 2, grayscale 4, grayscale 8, grayscale 16, and grayscale 32 which are successively arranged.

25. The driving method as claimed in claim 15, wherein:

each of the main frame and the compensation frame includes a plurality of sub-frames, and the frame of the image signal includes a first main frame of grayscale 1, a first compensation frame of grayscale 2, a second main frame of grayscale 4, a second compensation frame of grayscale 8, a third main frame of grayscale 16, a third compensation frame of grayscale 32, a fourth main frame of grayscale 64, a fifth main frame of grayscale 128, a fourth compensation frame of grayscale 64, a sixth main frame of grayscale 32, a fifth compensation frame of grayscale 16, a seventh main frame of grayscale 8, a sixth compensation frame of grayscale 4, an eighth main frame of grayscale 2, a seventh compensation frame of grayscale 1, and a blank frame arranged in that order.

* * * * *